US011167555B2

(12) United States Patent
Miyagawa et al.

(10) Patent No.: US 11,167,555 B2
(45) Date of Patent: Nov. 9, 2021

(54) RECORDING APPARATUS

(71) Applicant: SEIKO EPSON CORPORATION, Tokyo (JP)

(72) Inventors: Tetsuya Miyagawa, Shiojiri (JP); Shota Mizuno, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/779,888

(22) Filed: Feb. 3, 2020

(65) Prior Publication Data

US 2020/0247157 A1 Aug. 6, 2020

(30) Foreign Application Priority Data

Feb. 6, 2019 (JP) ..... JP2019-019549

(51) Int. Cl.
*B41J 2/175* (2006.01)
*B41J 29/02* (2006.01)
*B41J 25/00* (2006.01)

(52) U.S. Cl.
CPC ..... *B41J 2/175* (2013.01); *B41J 25/006* (2013.01); *B41J 29/02* (2013.01)

(58) Field of Classification Search
CPC ..... B41J 2/175
See application file for complete search history.

(56) References Cited

U.S. PATENT DOCUMENTS 5,686,947 A * 11/1997 Murray ..... B41J 2/17513 347/85
6,338,553 B1 * 1/2002 Lewis ..... B41J 2/175 347/85
6,402,277 B1 * 6/2002 Monclus ..... B41J 2/175 347/7
6,948,802 B2 * 9/2005 Koga ..... B41J 2/175 347/85
2019/0291425 A1 * 9/2019 Torigoe ..... B41J 2/14

FOREIGN PATENT DOCUMENTS

JP 2015-110280 A 6/2015

* cited by examiner

*Primary Examiner* — Shelby L Fidler
(74) *Attorney, Agent, or Firm* — Workman Nydegger

(57) ABSTRACT

When one of directions in which a carriage moves is a first scanning direction, and the other one of the directions is a second scanning direction, a tube extends in the first scanning direction, is bent in the second scanning direction with a curved portion, and is coupled to the carriage. The tube has a first portion, which is an immovable portion that does not move as the carriage reciprocates, and a second portion, which is a movable portion that moves as the carriage reciprocates. The first portion is fixed to a mounting plate, which is an example of a fixing section, the tube and a supporting member are held together by a holding member, and the mounting plate has a stepped portion, which is an example of a contact preventing portion configured to prevent contact with the holding member holding the movable portion of the tube.

4 Claims, 5 Drawing Sheets

RECORDING APPARATUS

The present application is based on, and claims priority from JP Application Serial Number 2019-019549, filed Feb. 6, 2019, the disclosure of which is hereby incorporated by reference herein in its entirety.

BACKGROUND

1. Technical Field

The present disclosure relates to a recording apparatus.

2. Related Art

Recording apparatuses that eject ink, which is an example of liquid, onto paper, which is an example of a recording medium, while reciprocating a carriage having a recording head to form images have been known as examples of recording apparatuses. Some of the recording apparatuses supply ink to a recording head from an ink tank that is disposed outside a carriage. These recording apparatuses have a flexible tube that can follow the reciprocating carriage to enable ink supply from an ink tank to a recording head.

In some cases, these recording heads in the recording apparatuses operate unstably when the operation of the tube is unstable, for example, when the tube hangs down. To solve the problem, in the recording apparatus disclosed in JP-A-2015-110280, a sheet member is installed along a tube to stabilize the operation of the tube to stabilize the operation of a recording head.

In the recording apparatus disclosed in JP-A-2015-110280, however, space is made between the tube and the sheet member, and in some cases, the tube operation is unstable during operation.

SUMMARY

According to an aspect of the present disclosure, a recording apparatus for solving the above-described problem includes a carriage having a liquid ejecting head configured to eject liquid onto a medium, the carriage being configured to reciprocate in scanning directions of the liquid ejecting head, a tube coupled to the carriage, the tube being configured to supply the liquid from a liquid storage container to the carriage, and a flexible supporting member that supports the tube. In the recording apparatus, when one of the directions in which the carriage moves is a first direction and the other one of the directions is a second direction, the tube extends in the first direction, is bent in the second direction with a curved portion, and is coupled to the carriage, the tube has a movable portion that moves as the carriage reciprocates and an immovable portion that does not move as the carriage reciprocates, the immovable portion is fixed to a fixing section, the tube and the supporting member are held together by a holding member, and the fixing section has a contact preventing portion configured to prevent contact with the holding member holding the movable portion of the tube.

DESCRIPTION OF EXEMPLARY EMBODIMENTS

Hereinafter, an embodiment of a recording apparatus will be described with reference to the attached drawings. The recording apparatus is, for example, an ink jet printer that performs recording by discharge ink, which is an example of liquid, onto paper, which is an example of a medium. In the following description, it is assumed that a recording apparatus 10 is placed on a horizontal plane, and the Z axis denotes a vertical direction, and the X axis and the Y axis denote directions along a plane that intersects the Z axis. The X axis, the Y axis, and the Z axis are orthogonal to each other, and thus the X axis and the Y axis extend along a horizontal plane. In the following description, a direction along the Z axis may be referred to as a vertical direction Z. Furthermore, in the following description, the vertical direction Z includes a first vertical direction Z1 that is the direction of gravity when the recording apparatus 10 is placed on a horizontal plane, and a second vertical direction Z2 that is the direction opposite to the first vertical direction Z1.

Figure 1:
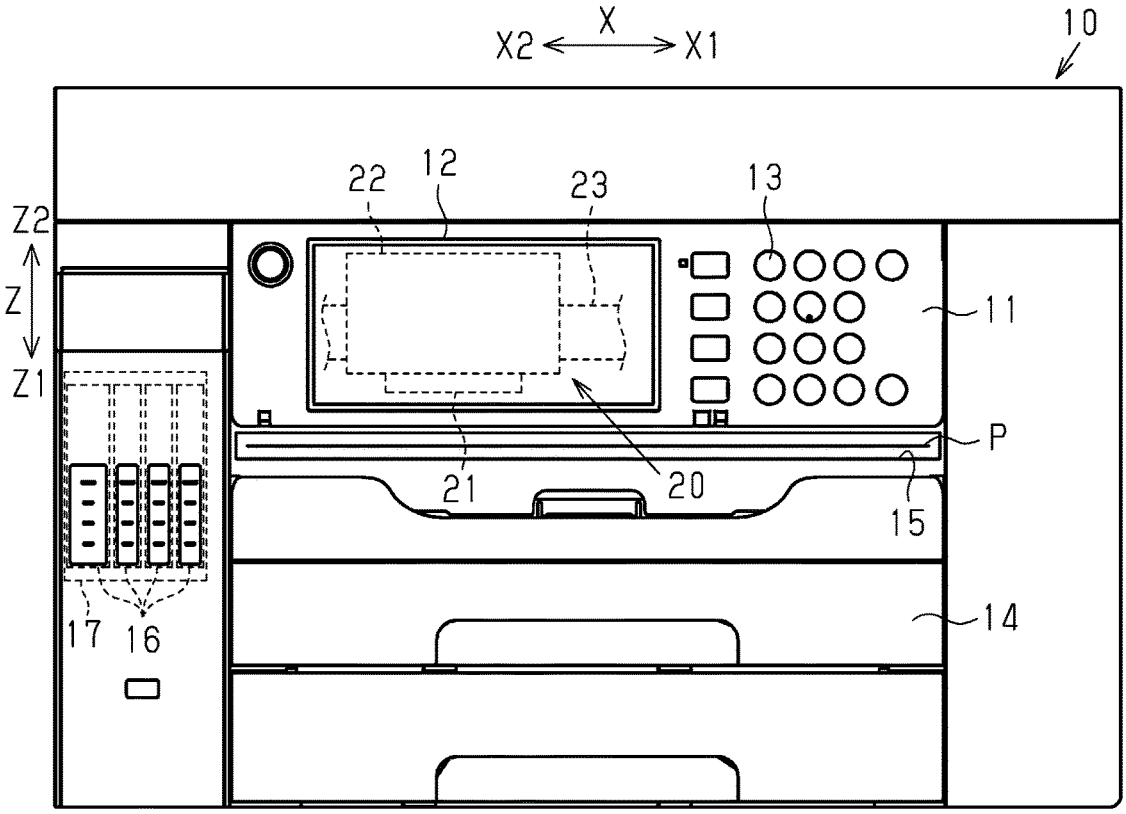
FIG. 1 is a front view illustrating a recording apparatus according to an embodiment.

As illustrated in FIG. 1, the recording apparatus 10 has an operation panel 11 that is operated by a user to issue an instruction to the recording apparatus 10. The operation panel 11 includes a display section 12 for displaying various kinds of information and an operation section 13 such as buttons to be operated by a user to input an instruction.

A paper storage section 14 that stores paper P, which is an example of a medium, is detachably attached to the recording apparatus 10. The paper storage section 14 can store a plurality of paper sheets P in a stacked manner. The paper storage section 14 is, for example, a cassette that can be detachably attached to the recording apparatus 10. The recording apparatus 10 includes a transport mechanism (not illustrated) for transporting the paper P. The paper P supplied from the paper storage section 14 is, by the transport mechanism, fed toward the rear side in the Y axis in the recording apparatus 10, reversed, and transported toward the front side in the Y axis direction. In the following description, the direction along the Y axis may be referred to as a transport direction Y toward which the paper P is transported. Furthermore, in the following description, the transport direction Y includes a first transport direction Y1 that is a direction toward the rear side when the recording apparatus 10 is viewed from the front, and a second transport direction Y2 that is the direction opposite to the first transport direction Y1.

The recording apparatus 10 has a discharge port 15 for discharging the paper P. The discharge port 15 is open on a front surface of the recording apparatus 10. The paper P recorded in the recording apparatus 10 is discharged from the discharge port 15 to the outside of the recording apparatus 10.

The recording apparatus 10 includes a liquid storage container 17 that accommodates one or a plurality of liquid storage sections 16. The liquid storage container 17 is fixed to a predetermined position. The liquid storage container 17 accommodates, for example, four liquid storage sections 16. Liquid stored in the liquid storage section 16 is used by the recording apparatus 10 for recording on the paper P.

The liquid storage sections 16 store, for example, different liquids. For example, the different liquids may be inks of different colors such as black, cyan, magenta, and yellow. The liquid storage section 16 is, for example, an ink pack. The liquid storage section 16 may be an ink tank or an ink cartridge.

The recording apparatus 10 includes a recording section 20 for recording on the paper P. The recording section 20 includes a liquid ejecting head 21 that ejects liquid onto the paper P for recording on the paper P, and a carriage 22 that has the liquid ejecting head 21. The liquid ejecting head 21 is mounted on the carriage 22 in a state in which the liquid ejecting head 21 is exposed from a lower surface of the carriage 22. The recording apparatus 10 includes a guiding section 23 that guides the carriage 22. The guiding section 23 extends along the X axis. The carriage 22 moves along the guiding section 23. Accordingly, the carriage 22 moves along the X axis. In the following description, the direction along the X axis may be referred to as a scanning direction X that is the moving direction of the carriage 22. In this embodiment, the carriage 22 can reciprocate in the scanning direction X. In the following description, the scanning direction X includes a first scanning direction X1 that is a direction from the left side toward the right side when the recording apparatus 10 is viewed from the front, and a second scanning direction X2 that is the direction opposite to the first scanning direction X1.

Figure 2:
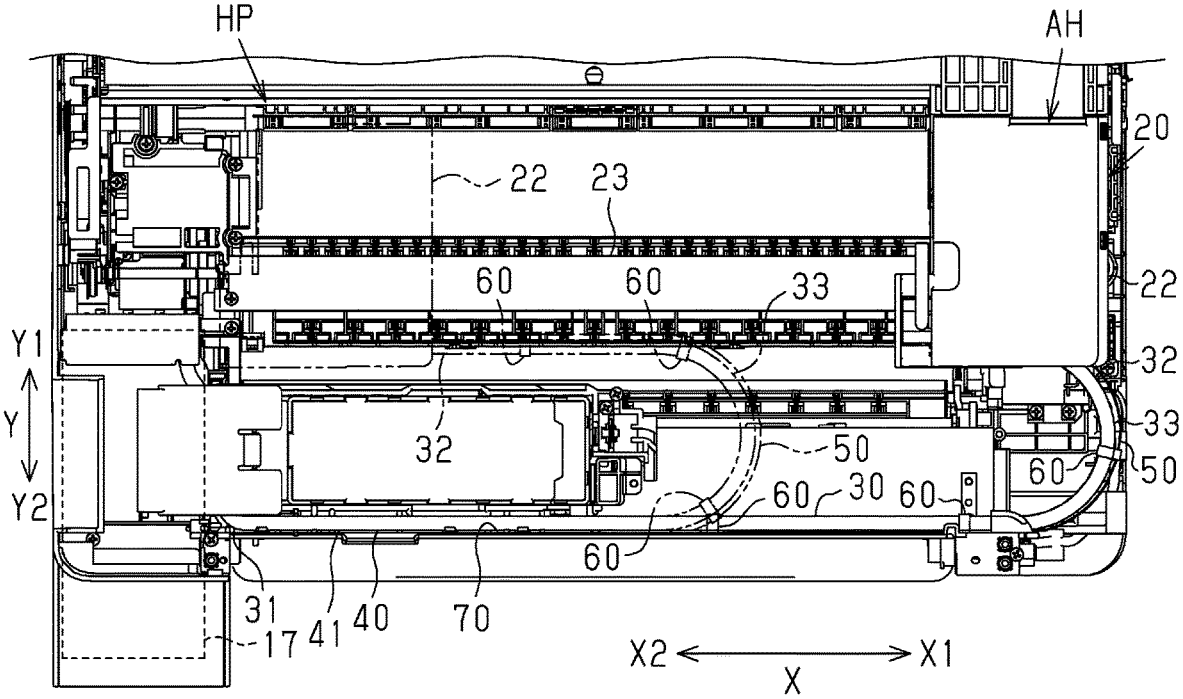
FIG. 2 is a plan view illustrating an internal structure of the recording apparatus.

As illustrated in FIG. 2, the carriage 22 stands by at a home position HP when the liquid ejecting head 21 performs no printing operation on the paper P. In this embodiment, as illustrated by the chain double-dashed line in FIG. 2, at the home position HP, the carriage 22 is supported at a position close to an end portion of the guiding section 23 on the second scanning direction X2 side.

An anti-home position AH of the carriage 22 is a position opposite to the home position HP in the scanning direction X. In this embodiment, as illustrated by the solid line in FIG. 2, the position of the carriage 22 supported at a position close to an end portion of the guiding section 23 on the first scanning direction X1 side is the anti-home position AH. The carriage 22 can reciprocate between the home position HP and the anti-home position AH. For example, in recording on the paper P, the carriage 22 reciprocates within a print zone that corresponds to a width of the paper P in a range between the home position HP and the anti-home position AH.

Next, a structure for supplying liquid stored in the liquid storage container 17 to the liquid ejecting head 21 will be described. As illustrated in FIG. 2, the recording apparatus 10 includes a supply member 30 for supplying liquid from the liquid storage container 17 to the carriage 22. The supply member 30 includes a tube bundle 40, a supporting member 50 that supports the tube bundle 40, and one or a plurality of holding members 60 that hold the tube bundle 40 and the supporting member 50 together.

Figure 3:
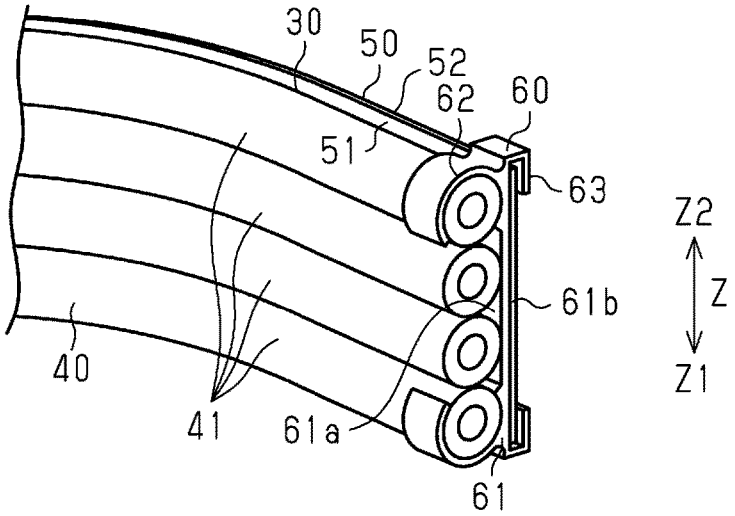
FIG. 3 is a cross-sectional view illustrating a supply member.

As illustrated in FIG. 3, the tube bundle 40 includes a plurality of tubes 41 disposed along the vertical direction Z. Each tube 41 is a cylindrical member made of a flexible material. Liquid can pass through the inside of each tube 41. Each tube 41 is flexible. In a state in which the tubes 41 are disposed along the vertical direction Z, some portions of the outer circumferential surfaces of adjacent tubes 41 in the vertical direction Z are coupled to each other. Accordingly, the tubes 41 are held each other and can be deformed and bent together.

As illustrated in FIG. 2, each tube 41 is coupled to the liquid storage container 17 on a side of a base end portion 31 of the supply member 30. In this embodiment, for example, each tube 41 is coupled to a corresponding liquid storage section 16 among the liquid storage sections 16 accommodated in the liquid storage container 17. Furthermore, each tube 41 is coupled to the carriage 22 on a side of a distal end portion 32 of the supply member 30. With this structure, each tube 41 can supply liquid from the liquid storage container 17 to the carriage 22. The carriage 22 has a supply path (not illustrated) for supplying the liquid from each tube 41 to the liquid ejecting head 21.

As illustrated in FIG. 3, the supporting member 50 is an elongated sheet-like member made of a flexible material. The supporting member 50 is flexible. The flexible material that forms the supporting member 50 may be, for example, a resin material such as polyethylene terephthalate (PET), or may be a metal material. The supporting member 50 has a first surface 51 and a second surface 52 that are in a front-back relationship. The supporting member 50 is disposed along the tube bundle 40 in a part of the supply member 30 on the distal end portion 32 side in a state in which the surface of the tube bundle 40 in a direction intersecting the direction in which the tubes 41 are arranged and the first surface 51 face each other. The length of the supporting member 50 in the vertical direction Z is the same or substantially the same as the width of the tube bundle 40 in the vertical direction Z.

The holding member 60 has a base portion 61 that extends in the vertical direction Z, a first locking portion 62 that locks the tube bundle 40, and a second locking portion 63 that locks the supporting member 50. The holding member 60 according to the embodiment is a separate member from the tube bundle 40 and the supporting member 50. The base portion 61 has a first holding surface 61*a* and a second holding surface 61*b* that are in a front-back relationship. The first locking portion 62 is on the first holding surface 61*a* side of the base portion 61. The second locking portion 63 is on the second holding surface 61*b* side of the base portion 61. The first locking portion 62 according to the embodiment has a locking piece that curves along the outer circumferential surface of the tube 41 at the upper end in the vertical direction Z, and a locking piece that curves along the outer circumferential surface of the tube 41 at the lower end. The first locking portion 62 protrudes more in the diameter direction of the tube 41 than the outer circumferential surface of the tube 41 in a state in which the tube bundle 40 is locked. The second locking portion 63 according to the embodiment has a locking piece that fits along the upper end of the supporting member 50 in the vertical direction Z, and a locking piece that has fits along the lower end. The locking piece of the second locking portion 63 has a claw shape that fits along the second surface 52 of the supporting member 50. The second locking portion 63 protrudes more than the second surface 52 in the direction perpendicular to the second surface 52 in a state in which the supporting member 50 is locked.

Figure 4:
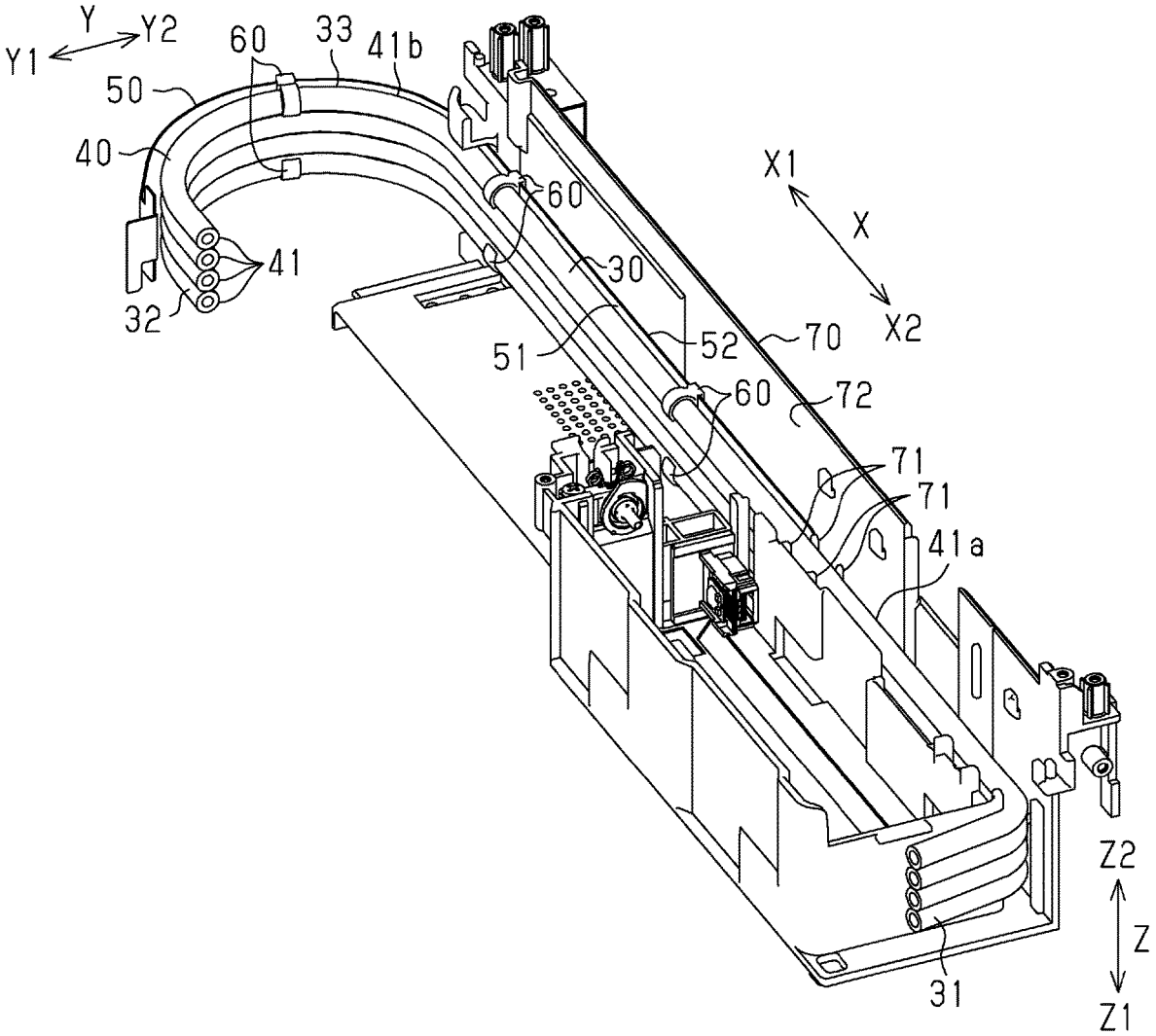
FIG. 4 is a perspective view illustrating the supply member and a mounting plate for fixing the supply member.

As illustrated in FIG. 4, the supply member 30 includes a plurality of holding members 60. The holding members 60 according to the embodiment are disposed at predetermined intervals in the longitudinal direction of the supply member 30. The tube bundle 40 and the supporting member 50 according to the embodiment are held together by the holding members 60 and can be deformed and bent together.

Figure 5:
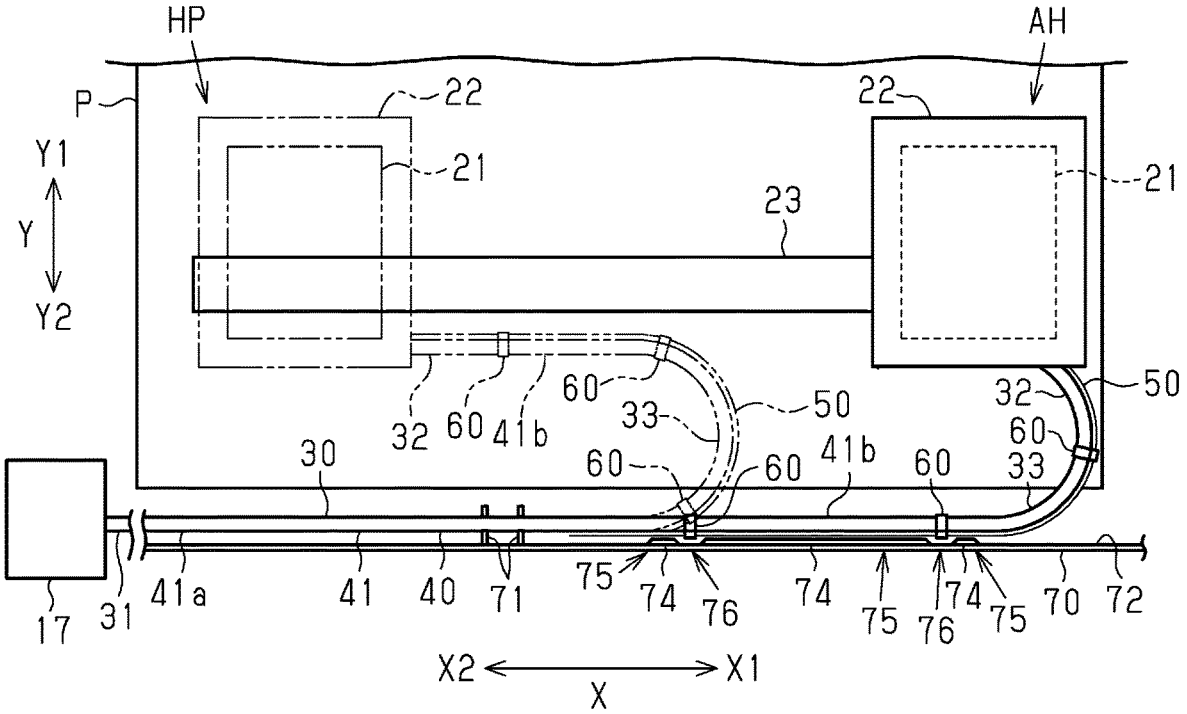
FIG. 5 is a schematic plan view illustrating the supply member.

As illustrated in FIG. 5, the supply member 30 extends from the base end portion 31 side in the first scanning direction X1 and is bent in the second scanning direction X2 to form a curved portion 33. The supply member 30 has, for example, the curved portion 33 that is convex in the first scanning direction X1 in plan view. The curved portion 33 is curved in a U shape from the front toward the rear in the transport direction Y along the horizontal plane. The curved portion 33 according to the embodiment is formed along the horizontal plane. The supply member 30 is reversed from the first scanning direction X1 to the second scanning direction X2 in the middle of the longitudinal direction, and the reversed portion is the curved portion 33. In this embodiment, the first scanning direction X1 is an example of a first direction, and the second scanning direction X2 is an example of a second direction.

In this embodiment, the length of the arc of the supply member 30 that corresponds to the curved portion 33 is longer than the interval between the holding members 60 disposed in the lengthwise direction of the supply member 30. In the curved portion 33, at least one holding member 60 among the holding members 60 is disposed. More specifically, the tube bundle 40 and the supporting member 50 of the supply member 30 are held together in the curved portion 33 by at least one holding member 60.

As illustrated in FIG. 4, the recording apparatus 10 includes a mounting plate 70 as an example of a fixing section for fixing the supply member 30. The mounting plate 70 is disposed along a surface that includes the scanning direction X and the vertical direction Z. The mounting plate 70 is disposed on the second transport direction Y2 side with respect to the supply member 30. Accordingly, the mounting plate 70 is closer to the front side than the supply member 30. The mounting plate 70 has one or a plurality of supply member holding portions 71 for holding the supply member 30. The supply member holding portion 71 is provided on a surface 72 of the mounting plate 70 on the first transport direction Y1 side. The supply member 30 is fixed to the mounting plate 70 with the tube bundle 40 held by the supply member holding portion 71. The supply member 30 according to the embodiment is fixed to the mounting plate 70 in a state in which the surface of the tube bundle 40 that faces the first surface 51 of the supporting member 50 faces the surface 72 of the mounting plate 70.

As illustrated in FIG. 5, the supply member 30 can be deformed as the carriage 22 moves. The base end portion 31 side of the supply member 30 is held by the supply member holding portion 71 and fixed in an immovable state with respect to the mounting plate 70 with the tubes 41 fixed to the liquid storage container 17. The part of the supply member 30 from the base end portion 31 to the portion at which the tube bundle 40 is held by the supply member holding portion 71 is fixed to the predetermined position accordingly. Specifically, a first portion 41*a* of each tube 41 from the base end portion, which is coupled to the liquid storage container 17, to the portion held by the supply member holding portion 71 is an immovable portion that cannot be moved in accordance with the movement of the carriage 22. On the other hand, the distal end portion 32 of the supply member 30 is fixed to the carriage 22 with the tubes 41 coupled to the carriage 22. The distal end portion 32 side of the supply member 30 can be moved as the carriage 22 moves with the tube bundle 40 and the supporting member 50 held together. The part of the supply member 30 from the portion at which the tube bundle 40 is held by the supply member holding portion 71 to the distal end portion 32 can be moved in accordance with the movement of the carriage 22. Specifically, a second portion 41*b* of each tube 41 from the portion at which the tube 41 is held by the supply member holding portion 71 to the distal end portion at which the tube 41 is coupled to the carriage 22 is a movable portion that can be moved in accordance with the movement of the carriage 22. Each tube 41 has the first portion 41*a*, which is an example of an immovable portion, and the second portion 41*b*, which is an example of a movable portion.

In this embodiment, for example, the supporting member 50 is provided along the second portions 41*b* of the tubes 41. In the supply member 30, the second portions 41*b* of the tubes 41 and the supporting member 50 can be deformed together as the carriage 22 moves.

The supply member 30 is fixed to the mounting plate 70 in a state in which the surface of the tube bundle 40 that faces the first surface 51 of the supporting member 50 faces the surface 72 of the mounting plate 70. When the carriage 22 is in the anti-home position AH, the second surface 52 of the supporting member 50 of the supply member 30 faces the mounting plate 70. When the carriage 22 is in the home position HP, the second surface 52 of the supporting member 50 of the supply member 30 is apart from the mounting plate 70. When the carriage 22 is in the anti-home position AH, a part of the second surface 52 of the supporting member 50 of the supply member 30 is in contact with the mounting plate 70. In accordance with the movement of the carriage 22 between the home position HP and the anti-home position AH, the supply member 30 can be deformed such that the second surface 52 of the supporting member 50 is away from the mounting plate 70 and the second surface 52 of the supporting member 50 is in contact with the mounting plate 70.

Figure 6:
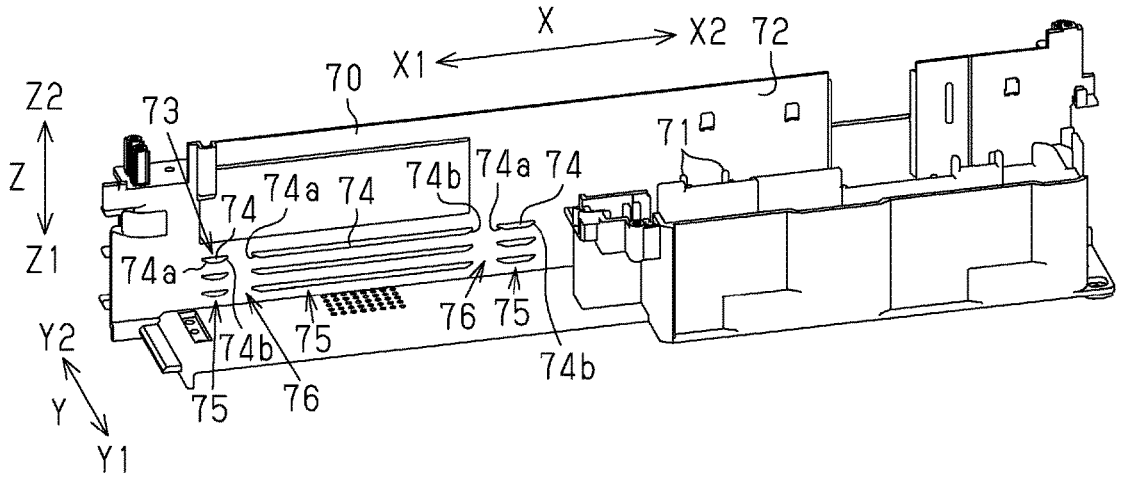
FIG. 6 is a perspective view illustrating the mounting plate.

As illustrated in FIG. 6, the mounting plate 70 has a stepped portion 73 at a position the mounting plate 70 faces the second surface 52 of the supporting member 50 when the carriage 22 is in the anti-home position AH. The stepped portion 73 is provided on the surface 72 of the mounting plate 70. The stepped portion 73 is provided on the first scanning direction X1 side with respect to the supply member holding portion 71. The stepped portion 73 has a rib portion 75 in which a rib 74 that protrudes from the surface 72 toward the first transport direction Y1 side is formed, and a non-rib portion 76 in which no rib 74 is formed. Accordingly, in the stepped portion 73, there is a difference in height from the surface 72 in the transport direction Y between the rib portion 75 and the non-rib portion 76. The rib portion 75 has a plurality of ribs 74 that extend in the scanning direction X in parallel with predetermined intervals in the vertical direction Z. The rib portions 75 and the non-rib portions 76 are alternately provided in the scanning direction X. In this embodiment, for example, the direction in which each rib 74 extends corresponds to the direction in which each tube 41 extends in the portion from the base end portion 31 to the curved portion 33 in the supply member 30. Accordingly, in the portion in which the surface 72 of the mounting plate 70 faces the second surface 52 of the supporting member 50, each rib 74 extends in the direction in which each tube 41 extends. The height of the protrusion of a first end portion 74*a* in the first transport direction Y1 on the first scanning direction X1 side of each rib 74 decreases toward the first scanning direction X1. The height of the protrusion of a second end portion 74*b* in the first transport direction Y1 on the second scanning direction X2 side of each rib 74 decreases toward the second scanning direction X2. In this embodiment, for example, each rib 74 has the first end portion 74*a* and the second end portion 74*b* that are curved such that the heights of the protrusion in the first transport direction Y1 decrease toward the ends.

Figure 7:
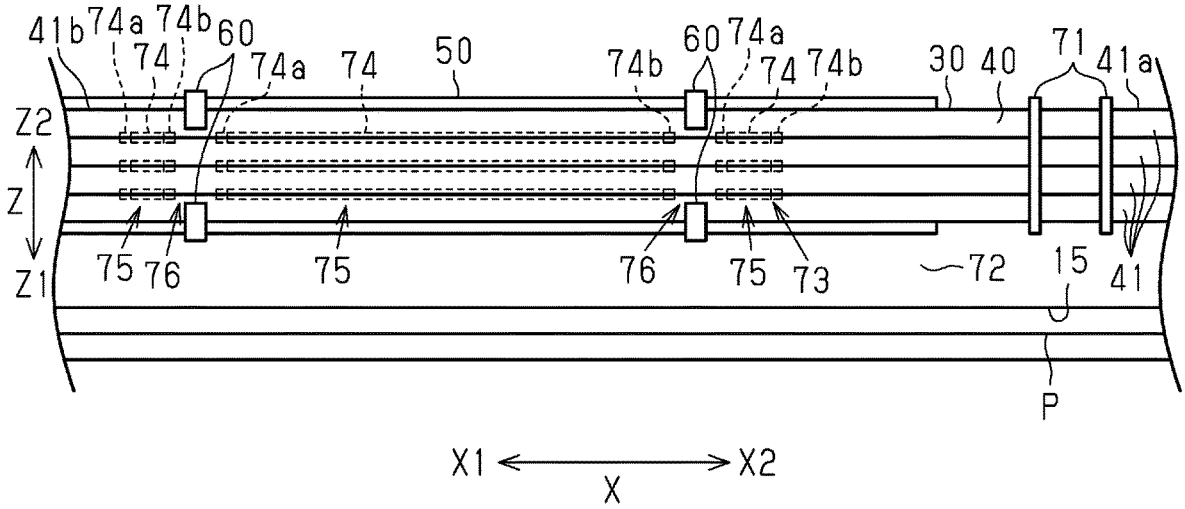
FIG. 7 is a schematic rear view illustrating the supply member.

As illustrated in FIG. 7, the stepped portions 73 of the mounting plate 70 have the non-rib portions 76 to face the second locking portions 63 of the holding member 60 when the carriage 22 is in the anti-home position AH. In the embodiment, for example, the stepped portion 73 has the portions in which no rib 74 is formed to correspond to the position of the holding member 60. With this structure, in the recording apparatus 10, when the carriage 22 is in the anti-home position AH, the second locking portions 63 of the holding member 60 are not in contact with the mounting plate 70. In this example in this embodiment, the stepped portion 73 is a contact preventing portion that prevents contact with the holding member 60.

Next, operations of the recording apparatus 10 will be described. As illustrated in FIG. 3, the holding member 60 holds the tube bundle 40 with the first locking portion 62 that has the locking piece that curves along the outer circumferential surface of the uppermost tube 41 among the tubes 41 in the vertical direction Z and the locking piece that curves along the outer circumferential surface of the lowermost tube 41. With this structure, the holding member 60 can hold the tube bundle 40 with substantially no space. The holding member 60 holds the supporting member 50 with the second locking portion 63 that has the locking piece that fits along the upper end of the supporting member 50 in the vertical direction Z and the locking piece that fits along the lower end. With this structure, the holding member 60 can hold the supporting member 50 with substantially no space. Accordingly, the holding member 60 can reduce or prevent the space between the tube bundle 40 and the supporting member 50.

The supporting member 50 of the supply member 30 is disposed such that, in the portion in which the second portion 41*b* of each tube 41 faces the surface 72 of the mounting plate 70, the first surface 51 faces the tube bundle 40 and the second surface 52 faces the surface 72. Accordingly, as the carriage 22 reciprocates between the home position HP and the anti-home position AH, the second surface 52 of the supporting member 50 of the supply member 30 is repeatedly deformed to be away from or to be in contact with the ribs 74 of the mounting plate 70.

The holding member 60 has the second locking portion 63 that protrudes more than the second surface 52 of the supporting member 50 in the direction perpendicular to the second surface 52. Accordingly, when the second surface 52 of the supporting member 50 faces the surface 72 of the mounting plate 70, the second locking portion 63 of the holding member 60 protrudes more than the second surface 52 toward the surface 72. The mounting plate 70 has the stepped portions 73 that have the non-rib portions 76 to face the second locking portions 63 of the holding members 60 when the second surface 52 of the supporting member 50 faces the surface 72 of the mounting plate 70. Specifically, the stepped portions 73 of the mounting plate 70 are formed such that the portions that face the second locking portions 63 of the holding member 60 are concave in the protruding direction of the second locking portions 63. With this structure, in the recording apparatus 10, the second locking portions 63 of the holding member 60 are prevented from coming into contact with the stepped portions 73.

Furthermore, in the stepped portion 73, the height of the protrusions of the first end portion 74*a* and the second end portion 74*b* of each rib 74 in the first transport direction Y1 decreases toward the ends. Accordingly, when the second surface 52 of the supporting member 50 faces the surface 72 of the mounting plate 70, the heights of the protrusions of the first end portion 74*a* and the second end portion 74*b* of each rib 74 toward the second surface 52 of the supporting member 50 decrease toward the ends of each rib 74. With this structure, in the recording apparatus 10, the second locking portions 63 of the holding member 60 can be further prevented from coming into contact with the first end portion 74*a* and the second end portion 74*b* of each rib 74.

The supply member 30 is deformed with the curved portion 33 changing its position with the reciprocation of the carriage 22 between the home position HP and the anti-home position AH. In such a case, since the holding members 60 are disposed at intervals shorter than the length of the supply member 30 that has the curved portion 33, at least one holding member 60 is provided in the curved portion 33. With this structure, the recording apparatus 10 can hold the tube bundle 40 and the supporting member 50 together by at least one holding member 60 in the curved portion 33 of the supply member 30.

Advantages of the embodiment will be described. 1. The supply member 30 holds the tube bundle 40 and the supporting member 50 together by the holding member 60 to reduce or prevent space between the tube bundle 40 and the supporting member 50. This structure enables the recording apparatus 10 to achieve stabilized operation of the supply member 30.

2. The second locking portion 63 in the holding member 60 protrudes more than the second surface 52 of the supporting member 50 in the direction perpendicular to the second surface 52. Accordingly, when the second surface 52 of the supporting member 50 faces the surface 72 of the mounting plate 70, the second locking portion 63 of the holding member 60 protrudes more than the second surface 52 of the supporting member 50 toward the surface 72 of the mounting plate 70. On the other hand, the mounting plate 70 has the stepped portion 73 that prevents contact with the holding members 60 in the supply member 30. With this structure, in the recording apparatus 10, it can be prevented or reduced that the second locking portion 63 of the holding member 60 comes into contact with the mounting plate 70 and affects the operation of the supply member 30. Accordingly, the recording apparatus 10 can achieve stabilized operation of the supply member 30.

3. The stepped portion 73 of the mounting plate 70 is formed such that the portion that faces the second locking portion 63 of the holding member 60 is concave in the protruding direction of the second locking portion 63. With this structure, in the recording apparatus 10, it can be prevented or reduced that the second locking portion 63 of the holding member 60 comes into contact with the mounting plate 70 and affects the operation of the supply member 30. Accordingly, the recording apparatus 10 can achieve stabilized operation of the supply member 30.

4. When the supply member 30 is deformed as the carriage 22 moves, the second surface 52 of the supporting member 50 is in contact with each rib 74 of the mounting plate 70. With this structure, in the recording apparatus 10, the supply member 30 can be stabilized while the second surface 52 of the supporting member 50 is in contact with each rib 74 of the mounting plate 70. Furthermore, the stepped portion 73 of the mounting plate 70 has the non-rib portion 76 to correspond to the position of the holding member 60. With this structure, in the recording apparatus 10, the second locking portion 63 of the holding member 60 is prevented from coming into contact with each rib 74 of the mounting plate 70 while the second surface 52 of the supporting member 50 is in contact with each rib 74 of the mounting plate 70, and thus the operation of the supply member 30 can be stabilized.

5. The curved portion 33 is bent along the horizontal surface from the first scanning direction X1 toward the second scanning direction X2. With this structure, the length of the supply member 30 in the vertical direction Z in the recording apparatus 10 can be reduced. Accordingly, the size of the recording apparatus 10 in the vertical direction Z can be reduced.

6. The mounting plate 70 is closer to the front side than the tubes 41. With this structure, in the recording apparatus 10, the supply member 30 can be prevented from coming into contact with the surface 72 of the mounting plate 70, which is closer to the front side than the tubes 41.

7. The recording apparatus 10 can hold the tube bundle 40 and the supporting member 50 together by at least one holding member 60 in the curved portion 33 when the position of the curved portion 33 is changed as the supply member 30 is deformed. With this structure, when the position of the curved portion 33 is changed as the supply member 30 is deformed, it can be reduced or prevented that the tube bundle 40 and the supporting member 50 are separated from each other in the recording apparatus 10 and the supply member 30 operates unstably.

8. When the carriage 22 is in the home position HP, the second surface 52 of the supporting member 50 is away from the ribs 74 of the mounting plate 70. With this structure, in the recording apparatus 10, the frequency of contact between the second surface 52 of the supporting member 50 and the ribs 74 of the mounting plate 70 can be reduced, and wear of the second surface 52 of the supporting member 50 and the ribs 74 of the mounting plate 70 can be reduced.

9. Since the tube bundle 40 and the supporting member 50 are separate components, the structural freedom of the holding member 60 is high, and the tube bundle 40 and the supporting member 50 can be held with substantially no space.

10. The height of the protrusions of the first end portion 74*a* and the second end portion 74*b* of each rib 74 in the first transport direction Y1 decreases toward the ends. With this structure, the holding member 60 less come into contact with the ribs 74 in the mounting plate 70 when the position of the holding member 60 is changed along the scanning direction X as the supply member 30 is deformed. Accordingly, unstable operation of the supply member 30 due to the holding member 60 coming into contact with the ribs 74 of the mounting plate 70 can be prevented or reduced.

11. The height of the protrusions of the first end portion 74*a* and the second end portion 74*b* of each rib 74 in the first transport direction Y1 decreases toward the ends. With this structure, in the recording apparatus 10, when the holding member 60 comes into contact with the first end portion 74*a* or the second end portion 74*b* of each rib 74, the holding member 60 can be guided to the non-rib portion 76 along the curve of the first end portion 74*a* or the second end portion 74*b*.

Figure 8:
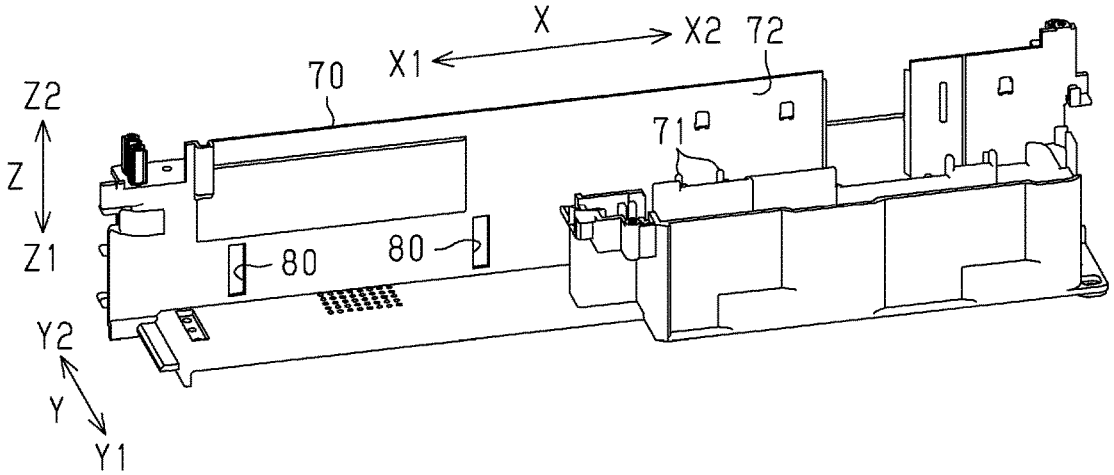
FIG. 8 is a perspective view illustrating a mounting plate according to a modification.

The embodiment may be modified and implemented as described below. The embodiment and the following modifications may be combined unless otherwise technically contradict each other. As illustrated in FIG. 8, the surface 72 of the mounting plate 70 may have openings 80 that are open on the first transport direction Y1 side as an example of a contact preventing portion that prevents contact with the holding member 60. The opening 80 may be a through hole that is open in the transport direction Y. With this structure, when the second locking portion 63 of the holding member 60 protrudes more than the second surface 52 of the supporting member 50, the second locking portion 63 of the holding member 60 and the mounting plate 70 can be prevented from coming into contact with each other.

The direction in which each tube 41 extends may be changed as appropriate. For example, each tube 41 may extend from the base end portion 31 side of the supply member 30 in the first scanning direction X1, be bent in the second scanning direction X2 to form the curved portion 33 that is bent in a U shape from the rear to the front in the transport direction Y, and be coupled to the carriage 22. In such a case, the mounting plate 70 that has the supply member holding portion 71 for holding the supply member 30 may be disposed at a position closer to the rear side than each tube 41. With this structure, in the recording apparatus 10, the holding member 60 can be prevented from coming into contact with the ribs 74 in the mounting plate 70 disposed at a position closer to the rear side than the tubes 41.

Figure 9:
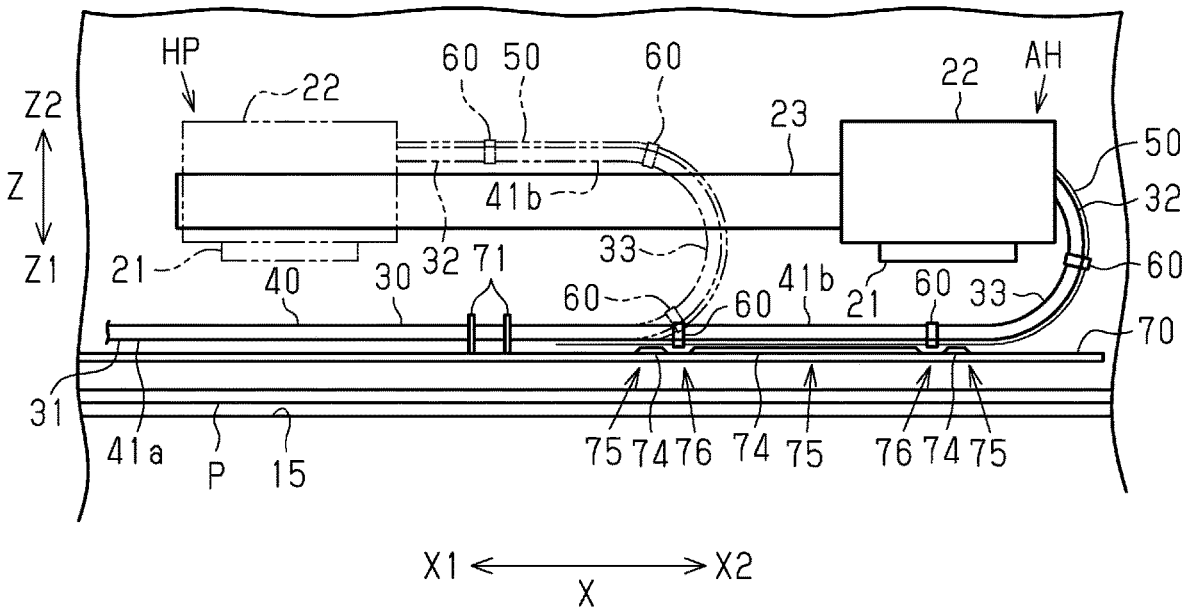
FIG. 9 is a schematic front view illustrating a supply member according to a modification.

As illustrated in FIG. 9, for example, each tube 41 may extend in the first scanning direction X1, be bent in the second scanning direction X2 to form the curved portion 33 that is bent in a U shape from downward to upward in the vertical direction Z, and be coupled to the carriage 22. Specifically, the curved portion 33 may be disposed along a flat plane that includes the scanning direction X and the vertical direction Z. With this structure, the length of the supply member 30 in the transport direction Y in the recording apparatus 10 can be reduced. Accordingly, the size of the recording apparatus 10 in the transport direction Y can be reduced. In such a case, the mounting plate 70 that has the supply member holding portion 71 for holding the supply member 30 may be disposed along a horizontal plane at a position closer to the first vertical direction Z1 side than each tube 41. In such a case, the surface 72 of the mounting plate 70 may be disposed at a position lower than each tube 41. With this structure, in the recording apparatus 10, the holding member 60 can be prevented from coming into contact with the ribs 74 in the mounting plate 70 disposed at a position lower than each tube 41. The mounting plate 70 that has the supply member holding portion 71 for holding the supply member 30 may be disposed along a horizontal plane at a position closer to the second vertical direction Z2 side than each tube 41. In such a case, the surface 72 of the mounting plate 70 may be disposed at a position upper than each tube 41. With this structure, in the recording apparatus 10, the holding members 60 can be prevented from coming into contact with the ribs 74 in the mounting plate 70 disposed at a position upper than each tube 41.

The liquid storage container 17 may be disposed on the right side in a front view of the recording apparatus 10. In such a case, each tube 41 may extend from the base end portion 31 side of the supply member 30 in the second scanning direction X2, be bent in the first scanning direction X1, and be coupled to the carriage 22.

The supply member 30 may be disposed such that a portion of the second surface 52 of the supporting member 50 is always in contact with the mounting plate 70. Specifically, the supply member 30 may be disposed such that at least a portion of the second surface 52 of the supporting member 50 repeats the separation and the contact with respect to each rib 74 of the mounting plate 70 when the supply member 30 is deformed as the carriage 22 moves.

The shape of each rib 74 may be changed as appropriate. For example, each rib 74 may have a uniform height protruding in the first transport direction Y1 in the entire area including the first end portion 74*a* and the second end portion 74*b*.

Each rib 74 in the mounting plate 70 may have a portion in which its height protruding in the first transport direction Y1 is low, as an example of a contact preventing portion. The mounting plate 70 may have a concave portion that is recessed more than the surface 72 of the mounting plate 70 toward the second transport direction Y2 side, as an example of a contact preventing portion.

The tubes 41 may not be coupled to each other. A part of or all of the tubes 41 may be different in shape. For example, the tubes 41 may have different diameters. Specifically, the tube bundle 40 may include tubes 41 that have different diameters. In such a case, the tubes 41 may be disposed and coupled to each other along the vertical direction Z. In this arrangement, the tube 41 that has a largest diameter among the tubes 41 may be disposed at an upper end or a lower end in the vertical direction Z. With this structure, the first locking portion 62 of the holding member 60 can hold the tube 41 that has a largest diameter in the tubes in the tube bundle 40, and thus unstable operation of the supply member 30 can be reduced.

The number of the tubes 41 may be one or more other than four. The home position HP and the anti-home position AH of the carriage 22 may be changed as appropriate. For example, the home position HP may be a position of the carriage 22 that is supported at a position close to the end portion of the guiding section 23 on the first scanning direction X1 side. Furthermore, the anti-home position AH may be a position of the carriage 22 that is supported at a position close to the end portion of the guiding section 23 on the second scanning direction X2 side.

The liquid storage container 17 may be detachably attached to the recording apparatus 10. The medium is not limited to the paper P, but may be cloth, a plastic film, a metal film, or the like.

The liquid that is discharged by the liquid ejection head 21 is not limited to ink; alternatively, the liquid may be, for example, a liquid material that contains particles of a functional material dispersed or mixed in a liquid. For example, the liquid ejecting head 21 may eject a liquid material containing a dispersed or dissolved material such as an electrode material or a pixel material used for manufacturing liquid crystal displays, electroluminescence displays, or field emission displays.

Technical ideas and effects from the above-described embodiments and modifications and their effects will be described below. A recording apparatus includes a carriage having a liquid ejecting head configured to eject liquid onto a medium, the carriage being configured to reciprocate in scanning directions of the liquid ejecting head, a tube coupled to the carriage, the tube being configured to supply the liquid from a liquid storage container to the carriage, and a supporting member that is flexible and supports the tube. In the recording apparatus, when one of directions in which the carriage moves is a first direction and an other one of the directions is a second direction, the tube extends in the first direction, is bent in the second direction with a curved portion, and is coupled to the carriage, the tube has a movable portion that moves as the carriage reciprocates and an immovable portion that does not move as the carriage reciprocates, the immovable portion is fixed to a fixing section, the tube and the supporting member are held together by a holding member, and the fixing section has a contact preventing portion configured to prevent contact with the holding member holding the movable portion of the tube.

With this structure, a tube and a supporting member are held together by a holding member, and thus space between the tube and the supporting member can be reduced or prevented. Furthermore, in this structure, a fixing section to which an immovable portion of the tube is fixed has a contact preventing portion configured to prevent contact with the holding member holding the movable portion of the tube. With this structure, the holding member that holds the tube and the supporting member can be prevented from coming into contact with the fixing section, and thus effects of the contact on the operation of the tube can be prevented or reduced. Accordingly, this structure can achieve stabilized operation of the tube.

In the recording apparatus, the contact preventing portion may be a stepped portion. With this structure, when the holding member protrudes more than the tube and the supporting member toward the fixing section side, the holding member and the fixing section can be prevented from coming into contact with each other.

In the recording apparatus, the fixing section may have a rib extending in the direction the tube extends, and a part of the contact preventing portion may have no rib to correspond to the position of the holding member holding the movable portion of the tube.

With this structure, the holding member and the fixing section can be prevented from coming into contact with each other while stabilizing the operation of the tube by allowing the rib to come into contact with the supporting member. In the recording apparatus, the contact preventing portion may be an opening.

With this structure, when the holding member protrudes more than the tube and the supporting member toward the fixing section side, the holding member and the fixing section can be prevented from coming into contact with each other. In the recording apparatus, the curved portion may be along a horizontal plane, and the fixing section may be disposed on a front side or a rear side with respect to the tube.

This structure enables the reduction in size in the vertical direction in the tube arrangement.

In the recording apparatus, the curved portion may be along a flat plane including a vertical direction and the carriage moving direction, and the fixing section may be disposed on an upper side or a lower side with respect to the tube.

This structure enables the reduction in size in a direction orthogonal to a flat plane that includes a vertical direction and the carriage moving direction in the tube arrangement.

What is claimed is:

1. A recording apparatus comprising:

a carriage having a liquid ejecting head configured to eject liquid onto a medium, the carriage being configured to reciprocate in a scanning direction of the liquid ejecting head;

a tube coupled to the carriage, the tube being configured to supply the liquid from a liquid storage container to the carriage; and a supporting member that is flexible and supports the tube, wherein when one of directions in which the carriage moves is a first direction and an other one of the directions is a second direction, the tube extends in the first direction, is bent in the second direction with a curved portion, and is coupled to the carriage, the tube has a movable portion that moves as the carriage reciprocates and an immovable portion that does not move as the carriage reciprocates, the immovable portion is fixed to a fixing section, the tube and the supporting member are held together by a holding member, and the fixing section has a contact preventing portion configured to prevent contact with the holding member holding the movable portion of the tube, wherein the contact preventing portion is a stepped portion and the fixing section has a rib extending in the direction the tube extends, and a part of the contact preventing portion has no rib to correspond to a position of the holding member holding the movable portion of the tube.

2. The recording apparatus according to claim 1, wherein the curved portion is formed along a horizontal plane, and the fixing section is disposed on a front side or a rear side with respect to the tube.

3. The recording apparatus according to claim 2, wherein the fixing section is a mounting plate that is vertically provided along a plane including the carriage moving directions and a vertical direction.

4. The recording apparatus according to claim 1, wherein the curved portion is formed along a flat plane including a vertical direction and the carriage moving directions, and the fixing section is disposed on an upper side or a lower side with respect to the tube.

* * * * *